US010052255B2

(12) United States Patent
Harvel

(10) Patent No.: US 10,052,255 B2
(45) Date of Patent: Aug. 21, 2018

(54) DEEP TISSUE MASSAGE LEVER ROLLER WITH SINGLE-HAND OPERATION

(71) Applicant: Curtis Harvel, Folsom, CA (US)

(72) Inventor: Curtis Harvel, Folsom, CA (US)

( * ) Notice: Subject to any disclaimer, the term of this patent is extended or adjusted under 35 U.S.C. 154(b) by 421 days.

(21) Appl. No.: 14/819,266

(22) Filed: Aug. 5, 2015

(65) Prior Publication Data

US 2016/0058656 A1 Mar. 3, 2016

Related U.S. Application Data

(60) Provisional application No. 62/042,704, filed on Aug. 27, 2014.

(51) Int. Cl.
*A61H 15/00* (2006.01)

(52) U.S. Cl.
CPC ..... *A61H 15/0092* (2013.01); *A61H 15/00* (2013.01); *A61H 2015/0014* (2013.01); *A61H 2201/0119* (2013.01); *A61H 2201/0126* (2013.01); *A61H 2201/0192* (2013.01); *A61H 2201/1261* (2013.01); *A61H 2201/1633* (2013.01); *A61H 2201/1635* (2013.01); *A61H 2201/1676* (2013.01)

(58) Field of Classification Search
None
See application file for complete search history.

(56) References Cited

U.S. PATENT DOCUMENTS 3,880,067 A * 4/1975 Hoffman ..... A22C 17/0093 99/472
4,299,207 A * 11/1981 Pfanstiel ..... A61H 7/004 601/114
5,244,444 A * 9/1993 Wostry ..... A63B 21/0615 482/109
5,973,248 A * 10/1999 Chen ..... G10D 13/026 248/441.1
6,974,427 B1 * 12/2005 Lapham ..... A61H 15/00 601/120
7,575,541 B2 * 8/2009 Chen ..... A61H 1/0218 482/143
8,007,414 B2 * 8/2011 Riney ..... A63B 21/0615 482/137
9,259,604 B2 * 2/2016 Miller, Jr. ..... A63B 21/068
2008/0061195 A1 * 3/2008 Carnevali ..... F16M 11/14 248/125.8
2014/0221881 A1 * 8/2014 Schlauder ..... A63B 21/0421 601/23

(Continued)

*Primary Examiner* — Stephen R Crow
(74) *Attorney, Agent, or Firm* — Plager Schack LLP; Mark H. Plager

(57) ABSTRACT

Some embodiments of the present disclosure include a deep tissue massager for single-hand operation. The deep tissue massager may include a support structure, at least one extendable pad pole adjustably and rotatably attached to and extending from the support structure, and a roller pad covering at least a portion the extendable pad pole, wherein the extendable pad pole and the roller pad are configured to be rolled against a user's muscle, releasing tension or knots in the muscle and returning the muscle closer to a relaxed state. The support structure may be, for example, a base platform with a support tower and main tower extending therefrom, a wall mountable rail, a portable rail, or a j-cup.

8 Claims, 8 Drawing Sheets

(56) References Cited

U.S. PATENT DOCUMENTS

| | | | | |
|---|---|---|---|---|
| 2016/0166465 | A1* | 6/2016 | Marson | A61H 15/00<br>601/121 |
| 2016/0338901 | A1* | 11/2016 | Cohen | A61H 15/00 |

* cited by examiner

DEEP TISSUE MASSAGE LEVER ROLLER WITH SINGLE-HAND OPERATION

RELATED APPLICATION

This application claims priority to provisional patent application U.S. Ser. No. 62/042,704 filed on Aug. 27, 2014, the entire contents of which is herein incorporated by reference.

BACKGROUND

The embodiments herein relate generally to athletic equipment, and more particularly, to a deep tissue massage lever roller with single-hand operation.

Many individuals experience muscle tightness and soreness, especially after engaging in athletic activities. However, it can be difficult to achieve the desired level of pressure on muscles when doing self-massage. Additionally, conventional devices that are designed to help alleviate this problem are unable to reach many muscle groups, such as the trapezius, pectoral, forearms, and biceps, effectively and comfortably.

Therefore, what is needed is a device that can effectively massage tight or sore muscles, including hard-to-reach muscles, by a single individual without requiring a second person to help.

SUMMARY

Some embodiments of the present disclosure include a deep tissue massager for single-hand operation. The deep tissue massager may include a support structure, at least one extendable pad pole adjustably and rotatably attached to and extending from the support structure, and a roller pad covering at least a portion the extendable pad pole, wherein the extendable pad pole and the roller pad are configured to be rolled against a user's muscle, releasing tension or knots in the muscle and returning the muscle closer to a relaxed state. The support structure may be, for example, a base platform with a support tower and main tower extending therefrom, a wall mountable rail, a portable rail, or a j-cup.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
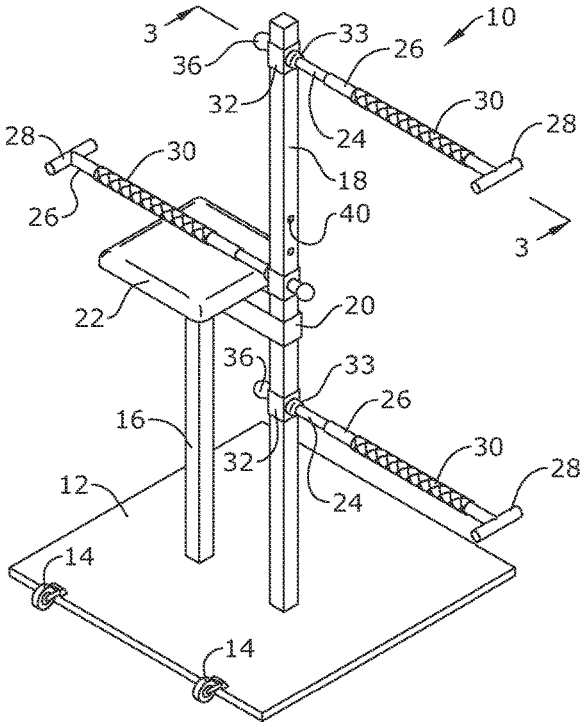
FIG. 1 is a front perspective view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to massage tight and/or sore muscles, including hard-to-reach muscles, without requiring a second person to help the self-massager and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Base Platform or Wall Mount
2. Extendable Poles with Roller Pads

The various elements of the deep tissue massager of the present disclosure may be related in the following exemplary fashion. It is not intended to limit the scope or nature of the relationships between the various elements and the following examples are presented as illustrative examples only.

By way of example, and referring to FIGS. 1-10, some embodiments of the device of the present disclosure comprise a massage apparatus 10 comprising a base platform 12, a main tower 18 and a support tower 16 extending perpendicularly upwards from the base platform 12, and extendable pad poles with roller pads 30 adjustable and rotatably attached to the main tower 18, the extendable pad poles with roller pads 30 configured to be rolled against a user's muscle, releasing tension or knots in the muscle and returning the muscle closer to its relaxed state. In embodiments, the main tower 18 and the support tower 16 may be attached to the support tower by, for example, a tower connection band 20, wherein the support tower 16 may provide additional support to the main tower 18, and the support tower 16 may comprise a support tower pad 22 configured to support at least one of the extendable pad poles, as desired. For example, the support tower pad 22 may be positioned at an end of the support tower 16 distal from the base platform 12. As shown in the figures, the support tower 16 may be shorter than the main tower 18.

Figure 2:
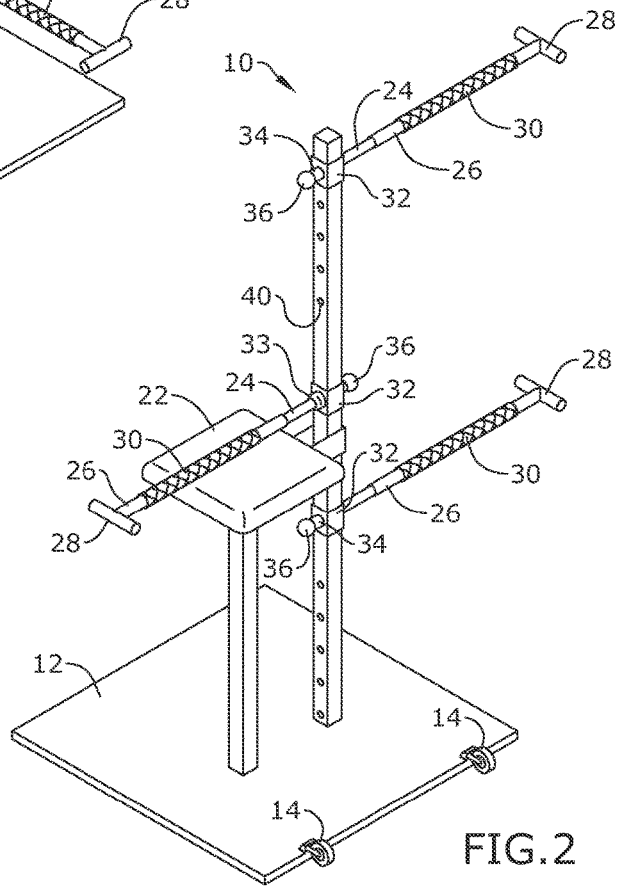
FIG. 2 is a rear perspective view of one embodiment of the present disclosure.
Figure 3:
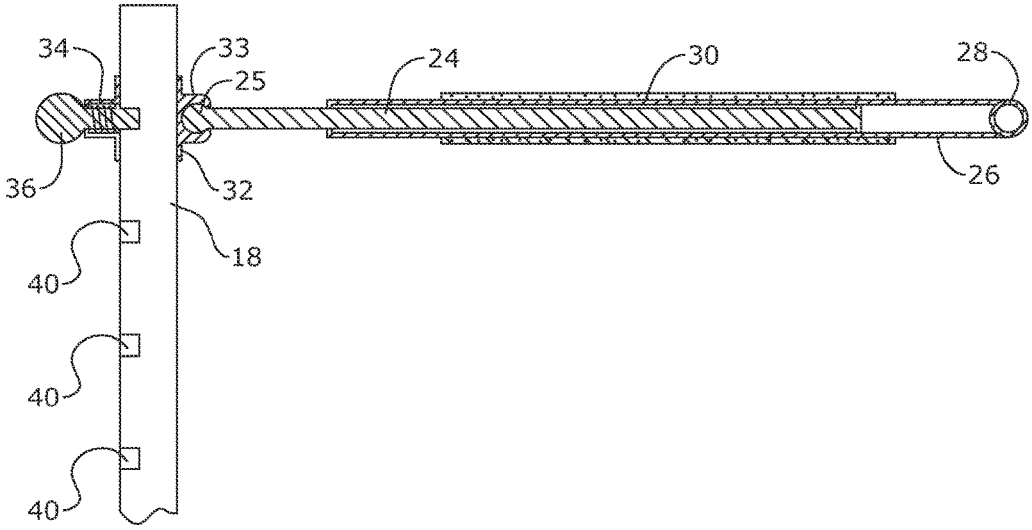
FIG. 3 is a section view of one embodiment of the present disclosure, taken along line 3-3 in FIG. 1.
Figure 4:
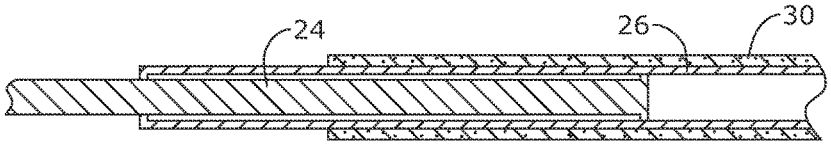
FIG. 4 is a detail section view of one embodiment of the present disclosure.
Figure 5:
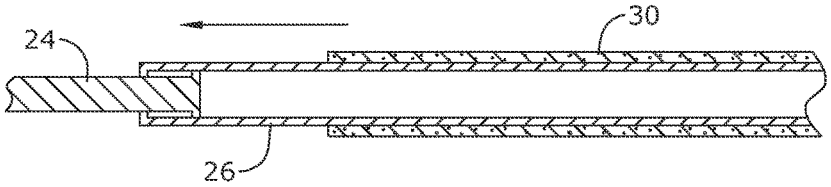
FIG. 5 is a detail section view of one embodiment of the present disclosure.
Figure 6:
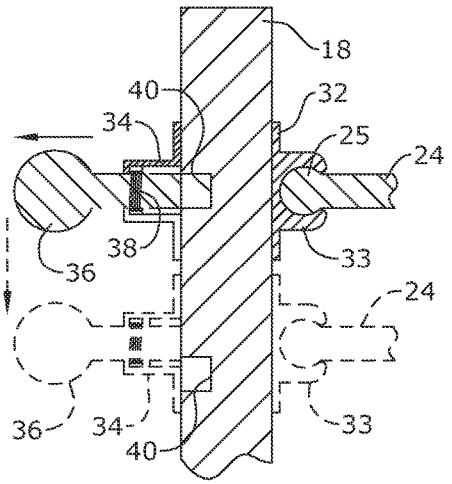
FIG. 6 is a detail section view of one embodiment of the present disclosure.
Figure 7:
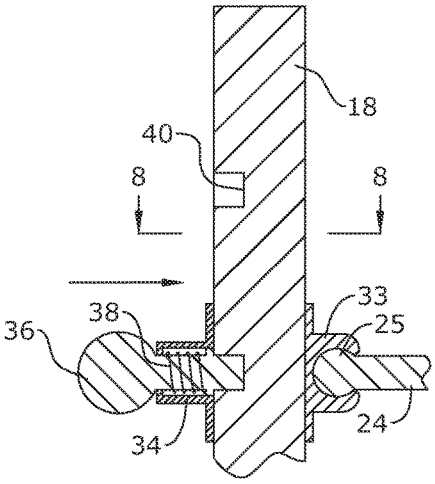
FIG. 7 is a detail section view of one embodiment of the present disclosure.
Figure 8:
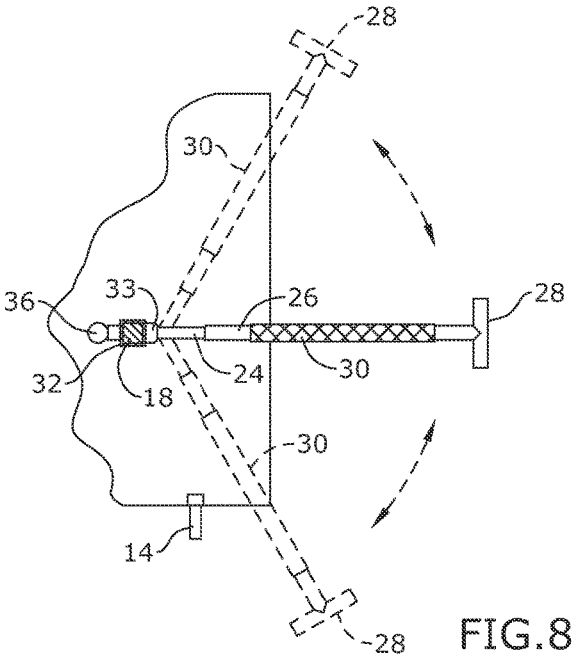
FIG. 8 is a section view of one embodiment of the present disclosure, taken along line 8-8 in FIG. 7.
Figure 9:
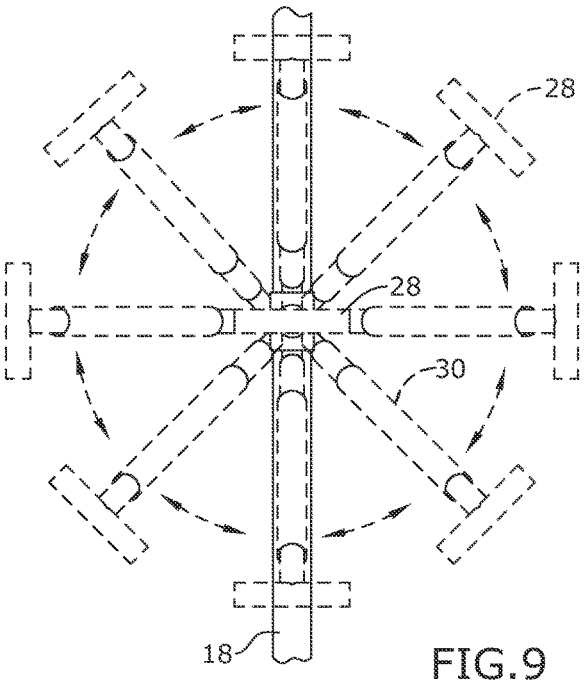
FIG. 9 is a detail front view of one embodiment of the present disclosure.

As shown in FIGS. 1 and 2, the main tower 18 may comprise a plurality of extendable pad poles, such as three extendable pad poles, extending therefrom. The pad poles may be adjustably and rotatably attached to the main tower 18, such that the height of the pad poles may be adjusted, as shown in FIGS. 6 and 7, and the pad poles may rotate about the main tower 18, as shown in FIG. 9. For example, the pad pole may comprise an end proximate to the main tower 18 and an end distal to the main tower 18, wherein the proximal end comprises a ball 25 and the distal end comprises a handle 28. The ball 25 may be configured to engage with a socket 33 positioned on a tower sleeve 32 adjustably attached to the main tower 18, wherein the ball 25 may rotate within the socket 33. The tower sleeve 32 may be configured to move up and down the main tower 18, the tower sleeve 32 being secured in the desired location by a pull pin 36, which is configured to engage with pin slots 40, as shown in FIGS. 3, 6, and 7. The pull pin 36 may engage with a sleeve neck 34 of the tower sleeve 32. When a user wishes to adjust the height of the pole bar, the user may pull on the pull pin 36, compressing a spring 38 within the sleeve neck and allowing the pull pin 36 to be moved from a first pin slot 40 to a second pin slot 40. In embodiments, the pad poles may be completely removed by pulling on the pull pin 36 and simultaneously pulling the ball 25 out of the socket 33. Thus, the massage apparatus 10 may be configured to be easily disassembled for storage and travel.

Between the handle 28 and the ball 32 of the pad pole may be a roller pad 30 covering at least a portion of the pad pole, as shown in the figures. Additionally, the pad pole may have an extendible length and, in some embodiments, telescopes outward to extend, wherein an inner pole 24 of the pad pole is configured to slide within an interior of an outer pole 26 of the pad pole, and the roller pad 30 is positioned around the outer pole 26. The handle 28 may be attached to the outer pole 26, such that when a user pulls on the handle 28, the outer pole 26 may telescope outwards from the main tower 18.

Figure 10:
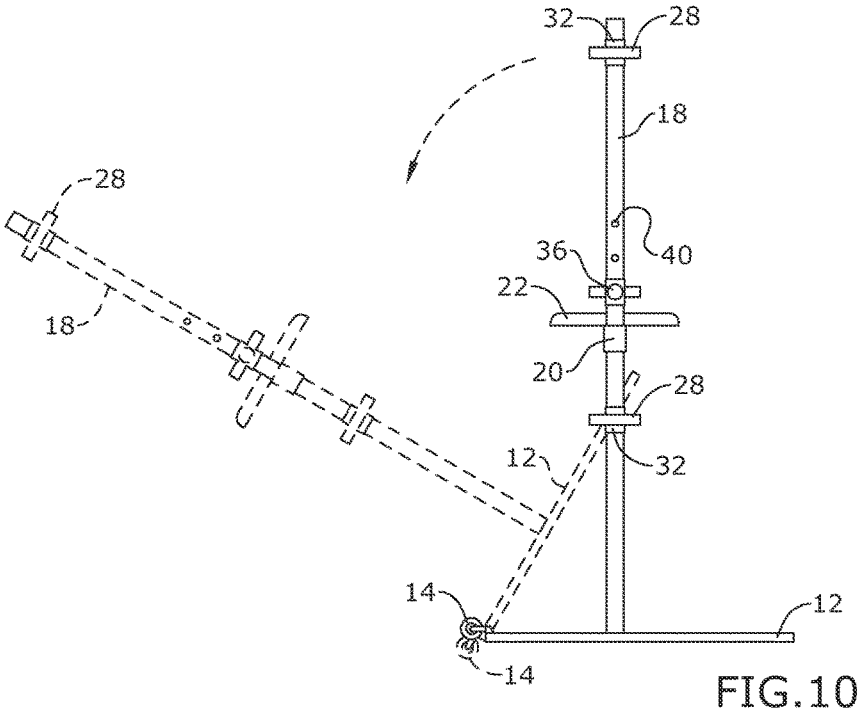
FIG. 10 is a front view of one embodiment of the present disclosure.
Figure 11:
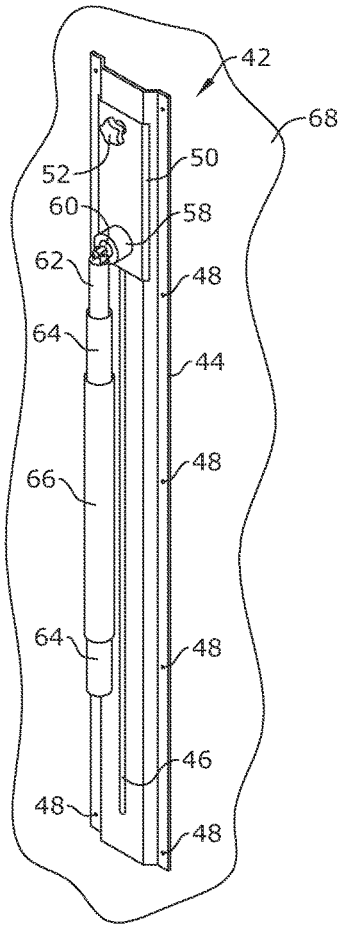
FIG. 11 is a perspective view of one embodiment of the present disclosure.
Figure 12:
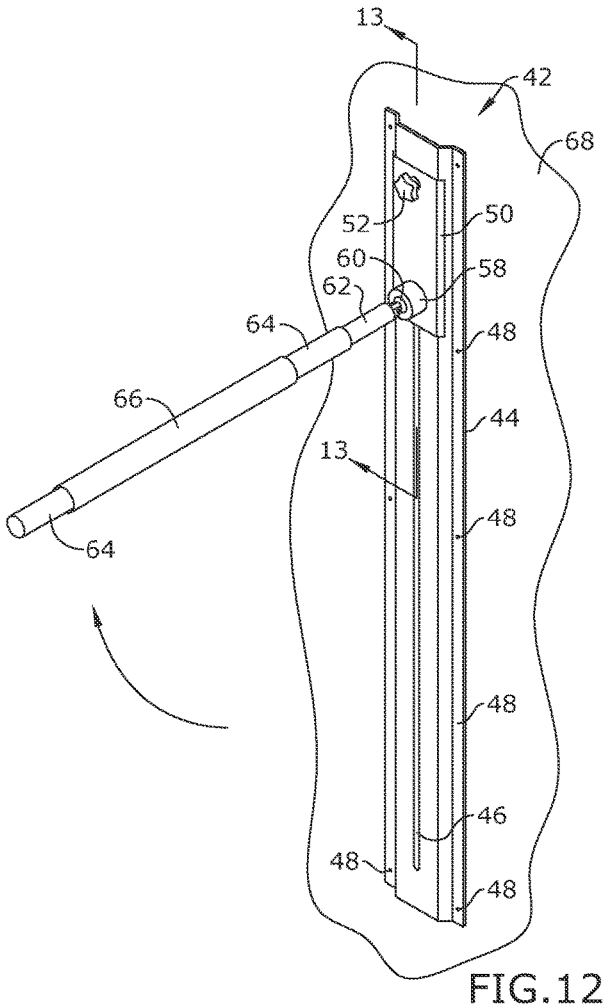
FIG. 12 is a perspective view of one embodiment of the present disclosure.
Figure 13:
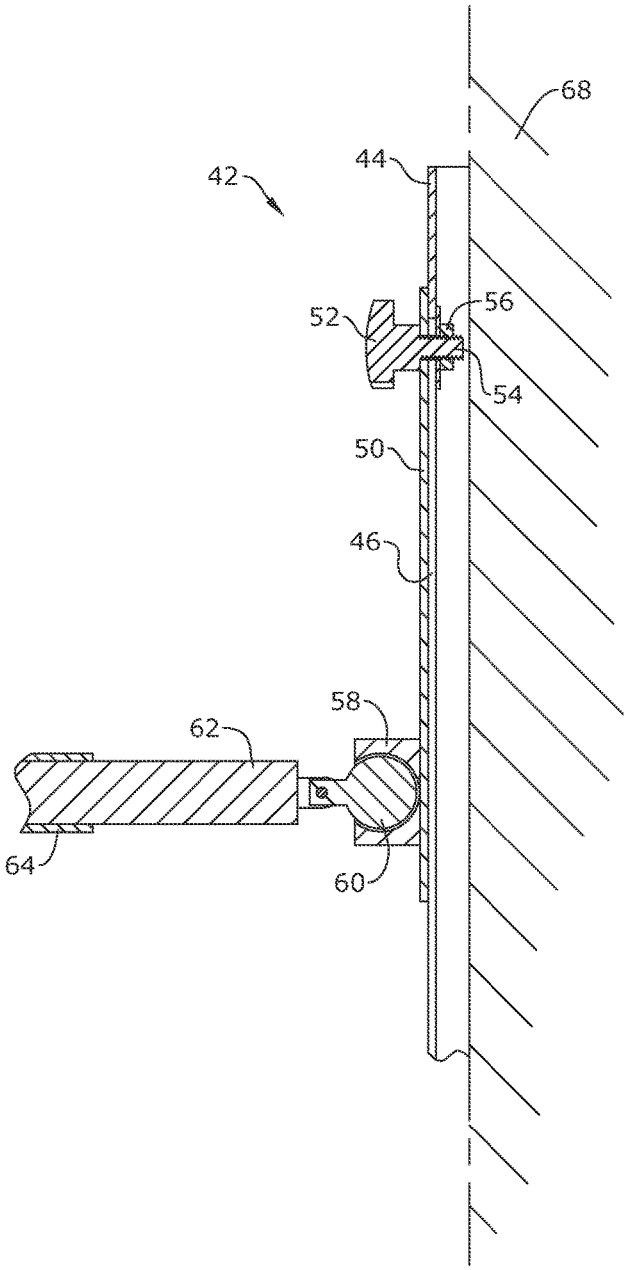
FIG. 13 is a section view of one embodiment of the present disclosure, taken along line 13-13 in FIG. 12.
Figure 14:
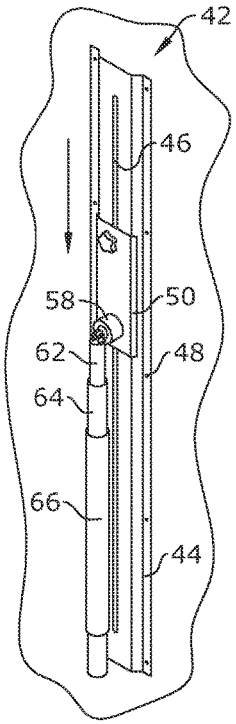
FIG. 14 is a perspective view of one embodiment of the present disclosure.

As shown in FIGS. 1, 2, and 10, the base platform 12 may comprise at least one wheel 14, such as a plurality of wheels, such as two wheels, attached to an outer edge thereof, wherein a user can tilt the massage apparatus 10 such that the wheels 14 are the only part of the apparatus 10 touching the ground allowing for the apparatus 10 to be easily transported.

An alternate embodiment of the present disclosure is shown in FIGS. 11-14, wherein the alternate embodiment comprises a mounted massage apparatus 42 configured to be mounted on a vertical surface, such as a wall 68. The mounted massage apparatus 42 may comprise a rail 44 mounted to the vertical surface by a fastener such as, for example, a plurality of screws 48, wherein the rail comprises a rail slot 46 configured to engage with an adjustment plate 50 via, for example, an adjustment knob 52, wherein the adjustment knob 52 comprises an adjustment bolt 54 extending therefrom, through the adjustment plate 50, and into the rail slot 46. An adjustment nut 56 may be positioned on the adjustment bolt 54 on a side of the rail slot 46 distal from the adjustment knob 52. When the adjustment knob 52 is rotated, the adjustment nut 56 may be tightened onto the adjustment bolt 54, causing the adjustment plate 50 to be tightly sandwiched between the adjustment knob 52 and the adjustment nut 56, securing the adjustment plate 50 to a desired position along a length of the rail 44. A ball socket 58 may extend from a surface of the adjustment plate 50 opposite the rail 44, wherein the ball socket 58 is configured to accommodate a ball mount 60. The ball mount 60 may extend, such as hingeably extend, from an alternate inner pole 62, which is configured to telescope within the alternate outer pole 64. Thus, the alternate inner pole 62 may be configured to be raised or pivot about the ball mount 60, such that the alternate inner pole 62 may extend from the mounted rail 44 at varying angles. At least a portion of the alternate outer pole 64 may be enveloped by an alternate roller pad 66.

Figure 15:
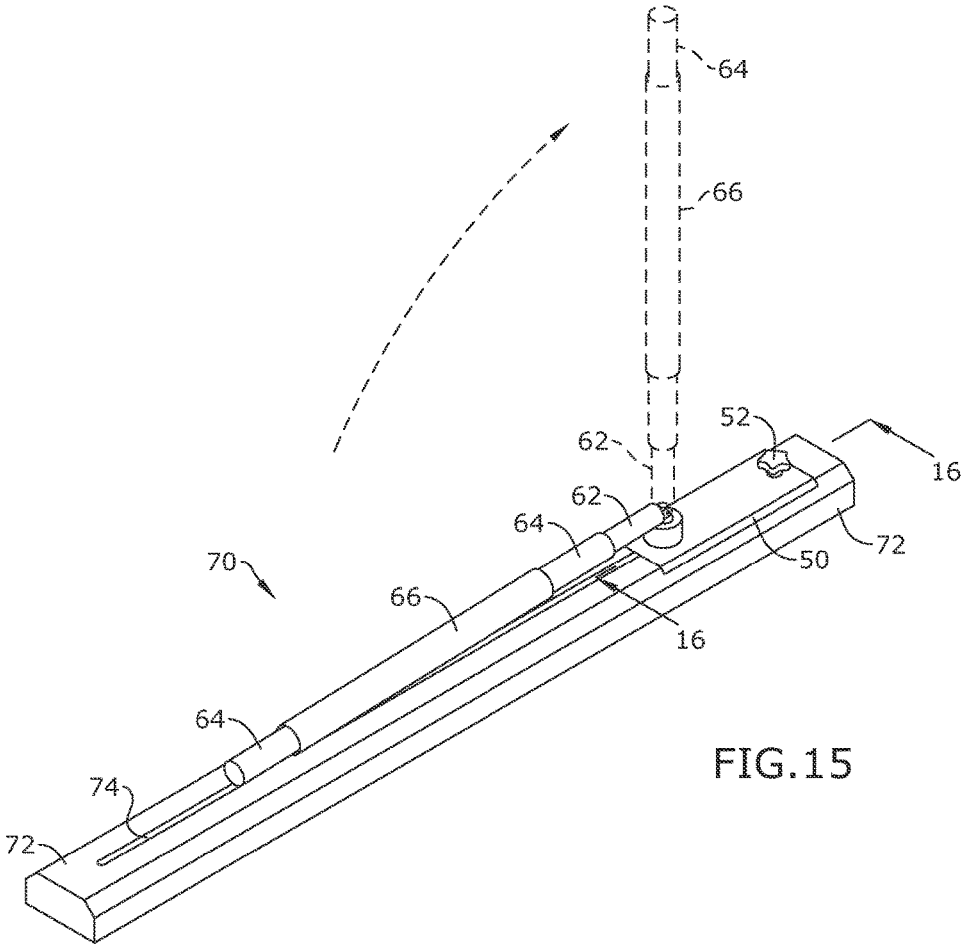
FIG. 15 is a perspective view of one embodiment of the present disclosure.
Figure 16:
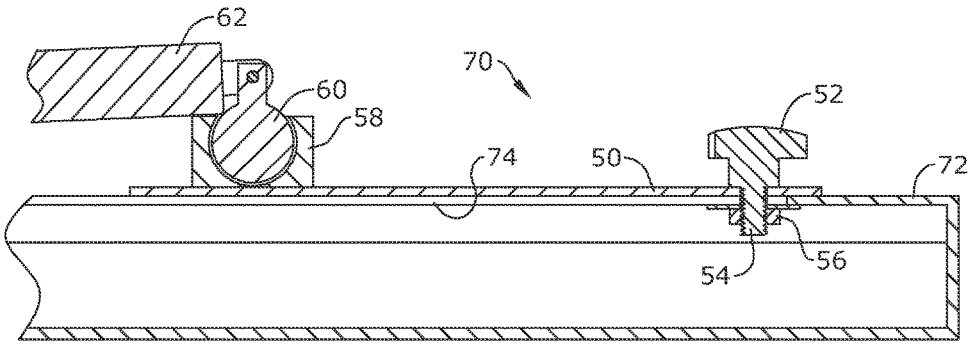
FIG. 16 is a section view of one embodiment of the present disclosure, taken along line 16-16 in FIG. 15.

As shown in FIGS. 15 and 16, another embodiment of the present disclosure may comprise a portable massage apparatus 70 having a structure similar to the mounted massage apparatus 42. However, instead of the mounted rail 44 and the mounted rail slot 46, the portable massage apparatus 70 may comprise a portable rail 72 with a portable rail slot 74. The remainder of the portable massage apparatus 70 may have the same structure as the mounted massage apparatus 42.

Figure 17:
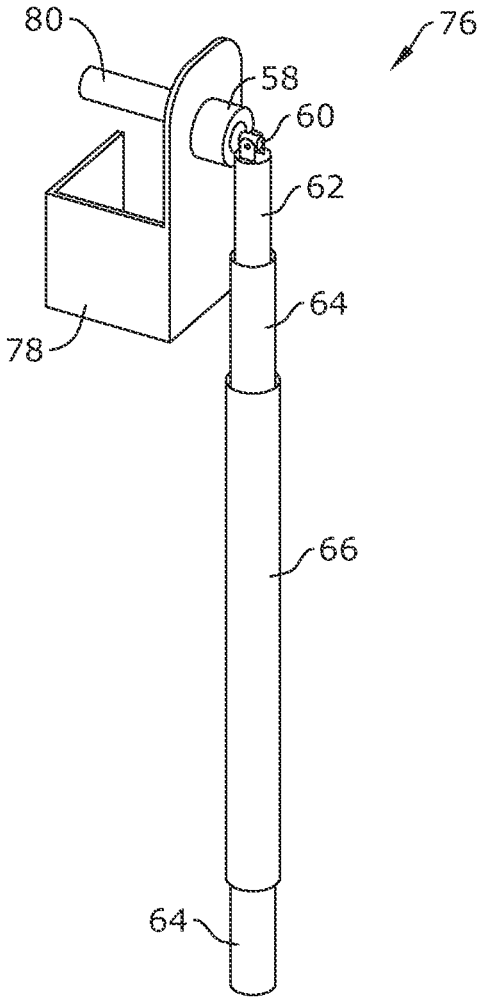
FIG. 17 is a perspective view of one embodiment of the present disclosure.

A yet further embodiment of the present disclosure may comprise a j-cup mounted massage apparatus 76, as shown in FIG. 17. The j-cup mounted massage apparatus 76 may comprise a j-cup configured to attach to another structure, the j-cup comprising a j-cup post 80 and a j-cup body 78. A ball socket 58 may extend from a surface of the j-cup, wherein the socket is configured to engage with a ball mount 60, similar to the mounted massage apparatus 42 and the portable massage apparatus 70, wherein the ball mount 60 is hingeably attached to an alternate inner pole 62 that is configured to telescope within an alternate outer pole 64, wherein at least apportion of the alternate outer pole 64 is enveloped by an alternate roller pad. Thus, in any embodiment, the deep tissue massager of the present disclosure may comprise a support structure from which at least one pole with a roller pad extends.

To use the deep tissue massager of the present disclosure, a user may position the extendable pad pole at a desired height on the support structure, hold an end of the extendable pad pole with one hand, and roll the roller pad against a tight, knotted, or sore muscle to release the muscle or knot and return the muscle closer to its preferred relaxation state.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A deep tissue massager for single-hand operation, the deep tissue massager comprising:

a base platform;

a main tower extending substantially perpendicularly outward from the base platform;

a support tower extending substantially perpendicularly outward from the base platform;

a tower connection band attaching the support tower to the main tower;

a plurality of extendable pad poles adjustably and rotatably attached to the main tower; and a roller pad covering at least a portion of each of the extendable pad poles, wherein the extendable pad poles and roller pads are configured to be rolled against a user's muscle, releasing tension or knots in the muscle and returning the muscle closer to a relaxed state.

2. The deep tissue massager of claim 1, further comprising a support tower pad positioned at an end of the support tower distal from the base platform, the support tower pad being configured to support at least one of the extendable pad poles.

3. The deep tissue massager of claim 1, wherein a height at which each of the plurality of extendable pad poles extends from the main tower is adjustable.

4. The deep tissue massager of claim 3, wherein:

each of the extendable pad poles comprises an end proximate to the main tower and an end distal to the main tower; and each of the proximal ends comprise a ball configured to engage with a respective socket positioned on a tower sleeve that is adjustably attached to the main tower, wherein the ball is configured to rotate within the socket.

5. The deep tissue massager of claim 4, wherein the tower sleeve is configured to move up and down the main tower, the tower sleeve being secured in a desired location by a pull pin that is configured to engage with pin slots in the main tower.

6. The deep tissue massager of claim 1, wherein each of the extendable pad poles comprises:

an inner pole configured to attach to the main tower;

an outer pole enveloping the inner pole, the outer pole configured to telescope outwardly from the main tower; and a roller pad enveloping at least a portion of the outer pole.

7. A deep tissue massager for single-hand operation, the deep tissue massager comprising:

a support structure is a rail configured to be mounted to a wall;

at least one extendable pad pole adjustably and rotatably attached to and extending from the support structure; and a roller pad covering at least a portion the extendable pad pole, wherein:

the extendable pad pole and the roller pad are configured to be rolled against a user's muscle, releasing tension or knots in the muscle and returning the muscle closer to a relaxed state;

the at least one extendable pad pole comprises a ball mount at a first end thereof;

the rail comprises a rail slot configured to engage with an adjustment plate via an adjustment knob, which secures the adjustment plate in a desired location about a length of the rail;

the adjustment plate has a ball socket extending from a surface of the adjustment plate opposite the rail; and the ball socket is configured to accommodate the ball mount.

8. The deep tissue massager of claim 7, wherein the adjustment plate is configured to slide along the length of the rail.

* * * * *